US006940386B2

(12) United States Patent
Mukherjee et al.

(10) Patent No.: US 6,940,386 B2
(45) Date of Patent: Sep. 6, 2005

(54) MULTI-LAYER SYMMETRIC INDUCTOR

(75) Inventors: Debanjan Mukherjee, San Jose, CA (US); Jishnu Bhattacharjee, San Jose, CA (US); Abhijit Phanse, Sunnyvale, CA (US)

(73) Assignee: Scintera Networks, Inc, San Jose, CA (US)

( * ) Notice: Subject to any disclaimer, the term of this patent is extended or adjusted under 35 U.S.C. 154(b) by 64 days.

(21) Appl. No.: 10/718,449

(22) Filed: Nov. 19, 2003

(65) Prior Publication Data

US 2005/0104705 A1 May 19, 2005

(51) Int. Cl.[7] ..... H01F 5/00

(52) U.S. Cl. ..... 336/200; 336/223; 336/232; 29/602.1

(58) Field of Search ..... 336/200, 232, 336/223; 29/602.1

(56) References Cited

U.S. PATENT DOCUMENTS

| | | | | |
|---|---|---|---|---|
| 4,816,784 | A * | 3/1989 | Rabjohn | 333/24 R |
| 6,002,161 | A * | 12/1999 | Yamazaki | 257/531 |
| 6,380,835 | B1 * | 4/2002 | Lee | 336/200 |
| 6,395,637 | B1 | 5/2002 | Park et al. | 438/706 |
| 6,593,838 | B2 | 7/2003 | Yue | 336/84 |
| 6,707,367 | B2 * | 3/2004 | Castaneda et al. | 336/200 |
| 6,759,937 | B2 * | 7/2004 | Kyriazidou | 336/200 |
| 6,801,114 | B2 * | 10/2004 | Yang et al. | 336/200 |
| 2004/0032314 | A1 * | 2/2004 | Kyriazidou et al. | 336/200 |

OTHER PUBLICATIONS

H.Y. D. Yang "Design Considerations of Differential Inductors in CMOS Technology", Dept. of ECE, University of Illinois at Chicago, no date, 3 pages.

* cited by examiner

*Primary Examiner*—Anh Mai
(74) *Attorney, Agent, or Firm*—MacPherson Kwok Chen & Heid LLP; Tom Chen

(57) ABSTRACT

An integrated circuit including a differentially excited symmetric microstrip inductor formed over multiple layers while maintaining both electrical and geometrical symmetry.

12 Claims, 2 Drawing Sheets

MULTI-LAYER SYMMETRIC INDUCTOR

BACKGROUND

1. Field of the Invention

The present invention pertains generally to integrated circuits, and more particularly, the present invention relates to integrated circuits having high quality inductors.

2. Related Art

Inductors are fabricated on to integrated circuits (IC) to minimize external components, to increase design flexibility and to reduce the overall cost of the IC. Generally, on-chip inductors are formed as a spiral structure which lies in a metal layer of the IC. Most IC applications require an inductor with a high Q (quality factor). The Q of an inductor is proportional to the magnetic energy stored in the inductor divided by the energy dissipated in the inductor in one oscillation cycle. The amount of magnetic energy stored in an inductor is directly proportional to the value of inductance of the inductor. The amount of energy dissipated in the inductor depends on resistive elements associated with the inductor.

In differential signal operation (i.e. two signals with the same magnitude, but with 180-degree phase difference), ICs generally use single mode asymmetric inductors in pairs, which are placed symmetrically on a common dielectric surface. To avoid unwanted electrical and magnetic coupling, the asymmetric inductors are placed far apart occupying more area. Differentially excited symmetric inductors, on the other hand, are area-efficient and have higher Q than single-ended structures. FIG. 1 is a top view of a typical symmetric inductor 100 including five turns. The symmetric inductor is designed for differential excitation and when excited differentially, currents in the adjacent turns follow in the same direction aiding the magnetic fields, which provides a higher inductance per area. Typically, the symmetric inductor structures are developed on one layer with an underpass layer.

What is needed is a multi-layer symmetric inductor having a higher Q when compared to single plane differential inductors, a lower self-resonant frequency and a minimal area occupancy.

SUMMARY

The present invention provides an integrated circuit (IC) including a differential inductor. In accordance with the present invention, the differential inductor is formed over multiple layers while maintaining both electrical and geometrical symmetry.

In one aspect of the invention, a differential inductor is provided which includes a a first conductive path lying in a first plane having a first portion coupled to a first port and a second portion coupled to a second port; a second conductive path lying in a second plane spaced apart from the first plane, having a first portion, a second portion, and a third portion; and a third conductive path and a fourth conductive path each lying in a third plane spaced apart from the first plane and the second plane. The first portion of the first conductive path is configured to receive a signal through the first port and couple the signal to the first portion of the second conductive path on the second plane. The first portion of the second conductive path is configured to couple the signal to the third conductive path on the third plane, which is configured to couple the signal to the second portion of the second conductive path on the second plane. The second portion of the second conductive path is configured to couple the signal to the fourth conductive path on the third plane, which is configured to couple the signal to the third portion of the second conductive path on the second plane. The third portion of the second conductive path is configured to couple the signal to the second portion of the first conductive path.

It should be understood that a signal received at the second port is coupled to each leg of the differential inductor in a reverse sequence relative to the signal received at the first port.

In another aspect a method is provided for forming a differential inductor. The method includes forming a first conductive path lying in a first plane having a first portion coupled to a first port and a second portion coupled to a second port; forming a second conductive path lying in a second plane spaced apart from the first plane having a first portion, a second portion and a third portion; and forming a third conductive path and a fourth conductive path each lying in a third plane spaced apart from the first plane and the second plane. The first portion of the first conductive path is configured to receive a signal through the first port and couple the signal to the first portion of the second conductive path on the second plane. The first portion of the second conductive path is configured to couple the signal to the third conductive path on the third plane, which is configured to couple the signal to the second portion of the second conductive path on the second plane. The second portion of the second conductive path is configured to couple the signal to the fourth conductive path on the third plane, which is configured to couple the signal to the third portion of the second conductive path on the second plane. The third portion of the second conductive path is configured to couple the signal to the second portion of the first conductive path.

The multi-layer differential inductor structure of the present invention provides the smallest area for a given inductance value L. This objective is accomplished since the multi layer differential inductor provides a Q proportional to the square of the number Z of layers per L (i.e. Q proportional to $Z^2$). Advantageously, as a result of this relationship the total area A of the IC consumed by the stacked inductor is $1/Z^2$ of the area $A_c$ of the area consumed by a single plane inductor (i.e. $A=(1/Z^2)A_c$). The multi-layer differential inductor occupies a lesser area than the single plane differential inductor, and provides a higher Q and the highest self-resonant frequency. The multi-layer differential inductor structure significantly reduces die-area and cost and increases the performance of the IC.

These and other features of the present invention will be more readily apparent from the detailed description of the embodiments set forth below taken in conjunction with the accompanying drawings.

A detailed description of embodiments according to the present invention will be given below with reference to accompanying drawings.

DETAILED DESCRIPTION

Figure 1:
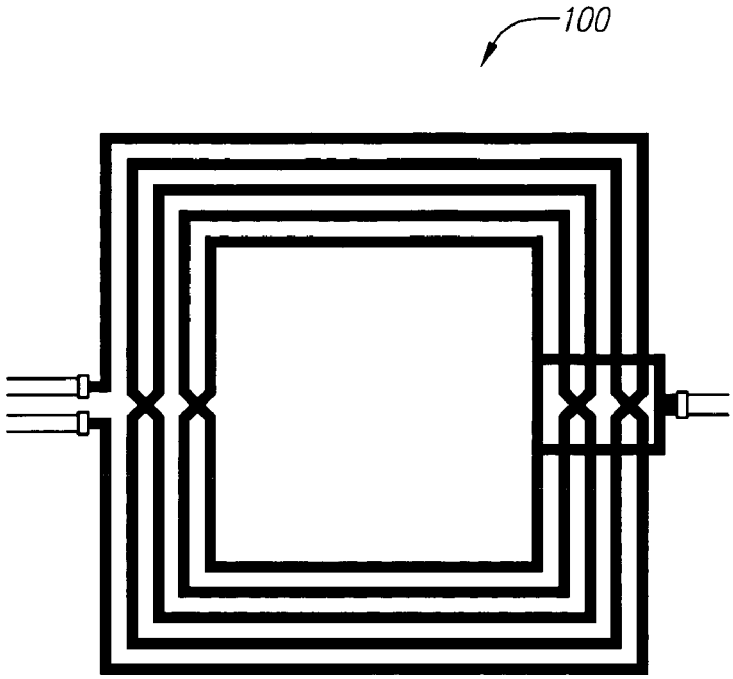
FIG. 1 (PRIOR ART)
FIG. 1 is a top view of a typical differential inductor having windings occupying a single dielectric plane.
Figure 2:
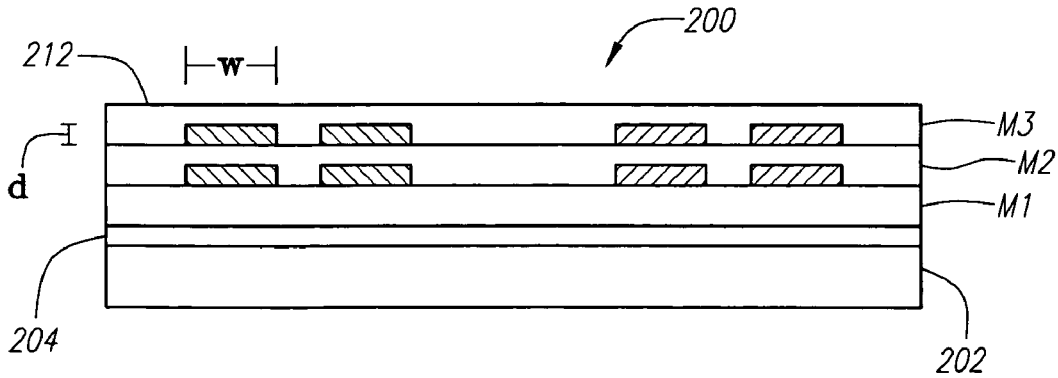
FIG. 2 is a simplified cross-sectional view of a differential inductor in accordance with an embodiment of the present invention.

FIG. 2 is a simplified cross sectional view of IC 200 in accordance with one representative embodiment of the present invention. Integrated circuit 200 includes silicon substrate 202 having semiconductor technology, such as CMOS active and passive elements, which are generally well known in the art.

In accordance with the present invention, a differential inductor is formed having windings or trace elements formed on multiple metal layers (M1, M2 . . . . MN) electrically coupled using strategically positioned pathways or vias to provide geometric as well as electrical symmetry.

In accordance with the present invention, a first dielectric layer 204, such as a tetraethylorthosilicate (TEOS)/borophosphosilicate glass (BPSG) is formed on substrate 202. A first metal layer M1 is deposited on first dielectric layer 204. A second dielectric layer, such as a silicon oxide layer, a silicon nitride layer, a silicon oxide/silicon nitride layer, or a $SiO_2$/SOG(spin-on-glass)/$SiO_2$ layer, is formed on the first metal layer. A first photoresist layer is formed on the second dielectric layer to form a first photoresist pattern.

The first photoresist pattern forms a pattern that resembles a desired winding or trace element. For example, as better shown in FIG. 3, in this embodiment, the first metal layer M1 is patterned as two separate trace elements 302 and 304, which resemble line segments. As described in greater detail below, trace elements 302 and 304 provide strategically placed underpass connections for the windings formed on layer M2.

The exposed second dielectric layer is dry etched using the first photoresist pattern as an etching mask, thus forming a line segment dielectric pattern on first metal layer M1. First metal layer M1 is dry etched using the photoresist pattern to form line segment trace elements 302 and 304. Trace elements 302 and 304 represent the fifth and seventh legs of the present embodiment.

Next, a third dielectric layer is formed over the resulting structure. A second photoresist layer is formed on the third dielectric layer to form a second photoresist pattern. The photoresist pattern provides an etching mask for the formation vias between metal layers M1 and M2. As described in more detail below, the vias provide an electrically conductive pathway between end portions of trace elements 302 and 304 and windings formed on layer M2. The remaining photoresist pattern is then removed.

Next, a second metal layer M2 is deposited on the resulting structure. A fourth dielectric layer, such as a silicon oxide layer, a silicon nitride layer or a silicon oxide/silicon nitride layer is formed on second metal layer M2.

After forming a photoresist layer on the fourth dielectric layer, a third photoresist pattern is formed to form windings on layer M2. In this embodiment, second metal layer M2 is formed into two windings, inner winding 306, which is formed of two concentric semi-circular portions 306*a* and 306*b* and an outer winding 308, which is formed of two concentric semi-circular portions 308*a* and 308*b*. The exposed fourth dielectric layer is dry etched using the third photoresist pattern as an etching mask, thus forming the inner winding 306 and outer winding 308.

Metal layer M2 is dry etched using the fourth dielectric pattern to form windings 306 and 308. Vias are strategically formed between layers M2 and M3 to provide electrically conductive pathways between windings 306 and 308 and the windings on layer M3.

Next, a third metal layer M3 is deposited on the resulting structure. A sixth dielectric layer is formed on third metal layer M3.

After forming a photoresist layer on the sixth dielectric layer a fifth photoresist pattern is formed to create windings. In this embodiment, the windings on metal layer M3 are formed having a substantially circular inner winding 312 and an outer winding including 314, which is formed of two concentric semi-circular portions 314*a* and 314*b*. The exposed sixth dielectric layer is dry etched using the fifth photoresist pattern as an etching mask, thus forming a winding pattern for windings 312 and 314.

Third metal layer M3 is dry etched using the sixth dielectric pattern to form windings 312 and 314. A passivation layer 212 can be formed as a dielectric layer protecting the differential inductor, once the desired number of layers is fabricated.

Metal layers M1–M3 can be formed to any thickness d and the trace elements or windings formed therefrom can be made to have any desired width w (FIG. 2). In one embodiment, to reduce resistance, the metal layers can have a thickness d of at least 1 $\mu$m. In other embodiments, thickness d can range from about 2 $\mu$m to about 5 $\mu$m. Each metal layer M1–M3 can be any suitably conductive material, such as copper (Cu), Aluminum (Al), alloys of these metals, and the like.

Although the exemplary embodiment just described shows a process for forming a differential inductor having three metal layers M1, M2 and M3, it should be understood by one of ordinary skill in the art that the same process can be extrapolated to form as many layers Mn (where n=1, 2, 3 . . . . ) as desired while maintaining geometric and electric symmetry of the differential inductor.

As best understood with reference to FIG. 3, each winding on each metal layer M1, M2 and M3 is electrically coupled through an electrically conductive pathway defined by vias to windings formed above and below as appropriate. The strategic positioning of the vias depends on which portion of the windings are to be coupled together to form differential inductor 300. The vias are formed in a well-known manner between each layer M1–M3. As described below, each via is strategically positioned to ensure that the appropriate contact between windings is maintained.

Figure 3:
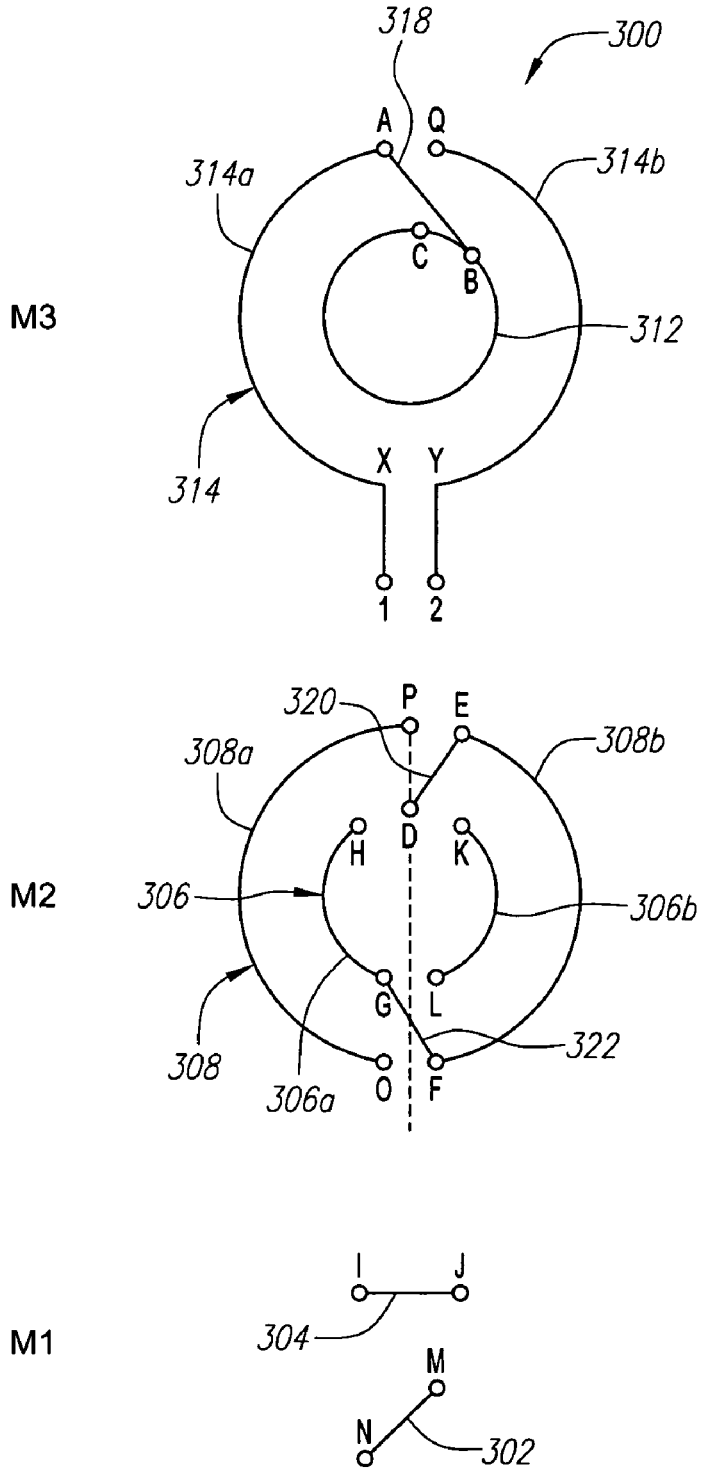
FIG. 3. is a simplified illustration of a the windings or traces of the differential inductor as formed on multiple layers in accordance with an embodiment of the present invention.

In the embodiment shown in FIG. 3, port 1 is coupled to outer winding 314 at node X. Winding 314*a* terminates at node A on layer M3 after making a substantially semi-circular turn. A lead 318 also formed on metal layer M3 couples node A of outer winding 314*a* to node B of inner winding 312. Inner winding 312 is formed as a substantially circular winding which terminates at node C. A via formed between layers M3 and M2 couples node C of winding 312 to node D on layer M2. A lead 320 couples node D to node E of outer winding 308*b*.

On layer M2, outer winding 308*b* forms a substantially semi-circular winding which terminates at node F. A lead 322 on layer M2 couples node F to node G on inner winding 306*a*. Inner winding 306*a* forms a substantially semi-circular winding which terminates at node H. Another via formed between layers M2 and M1 couples node H to node I of trace element 304 on layer M1.

Trace element 304 on metal layer M1 forms a bridge between node I and J to form an underpass for winding 306 on metal layer M2. At node J, a via is formed between layers M1 and M2 to allow node J to be coupled to node K of inner winding 306*b* of layer M2. Inner winding 306*b* forms a substantially semi-circular winding which terminates at node L.

Another via formed between layers M2 and M1 couples node L to node M of trace element 302 on layer M1. Trace element 302 on metal layer M1 forms a bridge between node M and N to form an underpass to couple inner winding 306*b* on metal layer M2 to outer winding 308*a* also on metal layer M2. Accordingly, at node N, a via is formed between layers M1 and M2 to allow node N to be coupled to node O of outer winding 308*a* of layer M2.

Outer winding 308*a* forms a substantially semi-circular winding, which is substantially a mirror image of winding 308*b*, which terminates at node P. A via formed between layers M2 and M3 allows node P of outer winding 308*a* to be coupled to node Q of outer winding 314*b* on layer M3.

Outer winding 314*b* is substantially a mirror image of outer winding 314*a*. Outer winding 314*b* forms a substantially semi-circular winding that terminates at node Y coupling the winding to port 2 on layer M3.

Differential inductor 300 including multiple layers in accordance with an embodiment of the present invention can have any number of layers (m). In this example, differential inductor 300 includes three metal layers M1, M2 and M3, with layers M2 and M3 each having a comparable pair of inner and outer windings, and M1 having trace elements.

It should be understood that differential inductor 300 can include any number of windings formed at each layer, which can be varied based on a specific application. In one embodiment, the number of windings per layer can range from 1 to 4, for example, 2.

In one embodiment, each winding of the present invention can be formed of a plurality of straight segments. As the number of windings increases, the number of segments per winding may also increase. The increased number of segments per winding causes the performance of the spiral inductor to approach that which would be achieved with a perfectly circular winding. In one embodiment, the number of segments per winding can range from between 4 and 8 segments per turn. Preferably, the number of segments per winding is 4 or greater.

By placing windings of differential inductor 300 on a plurality of layers, such as layers M1, M2 and M3, the area of the silicon consumed by differential inductor 300 can be substantially reduced. Beneficially, this allows the final IC product to be made smaller, and therefore, with a greater economy of scale in manufacturing. This benefit is illustrated with the following example.

With reference to equation (1), an IC including, for example, a differential inductor of three layers (n) can achieve 9 times the inductance (L) of a single spiral inductor having a given diameter with a given inductance.

$$L_{eff}=n^2L \quad (1)$$

Thus, in this example, the area that would otherwise be consumed by a single layer inductor on the IC can be reduced by a factor of 9. Since the inductor in silicon technology is the dominant factor in the size of the ICs for multigigahertz RF/broadband applications, reducing the inductor to a size ⅙ of its former size, translates into almost a ⅙ reduction in chip size.

The small inductor radius provides the ability to reduce the total capacitance associated with the inductor relative to the substrate. This increases the self-resonant frequency of the IC and allows the IC to be used at higher frequencies. This particular advantage is amplified for communication technologies in the gigabit range, for example, as the frequencies for digital transmission enter into the 10 gigabit to 40 gigabit range.

In one embodiment, the dimensions of spiral inductors and the number of layers required can be determined through an iterative design process to provide a desired inductance for a given set of input parameters.

Having thus described embodiments of the present invention, persons skilled in the art will recognize that changes may be made in form and detail without departing from the scope of the invention. The scope of the invention should be determined with reference to the following claims together with the full scope of the variants of such claims.

What is claimed is:

1. A differential inductor comprising:

a first conductive path lying in a first plane having a first portion coupled to a first port and a second portion coupled to a second port;

a second conductive path lying in a second plane spaced apart from the first plane, having a first portion, a second portion, and a third portion; and a third conductive path and a fourth conductive path each lying in a third plane spaced apart from the first plane and second plane;

said first portion of said first conductive path configured to receive a signal through the first port and couple the signal to the first portion of said second conductive path on said second plane, said first portion of said second conductive path configured to couple the signal to the third conductive path on said third plane, said third conductive path configured to couple the signal to said second portion of said second conductive path on said second plane, said second portion of said second conductive path configured to couple the signal to said fourth conductive path on said third plane, said fourth conductive path configured to couple the signal to the third portion of said second conductive path on said second plane, and said third portion of said second conductive path configured to couple the signal to the second portion of said first conductive path.

2. The differential inductor of claim 1, wherein said first plane is substantially parallel to said second and third planes.

3. The differential inductor of claim 1, wherein said first, second, third, and fourth conductive paths comprise metal windings.

4. The differential inductor of claim 1, wherein said conductive paths couple said signal to each other conductive path with electrically conductive pathways formed between each plane.

5. The differential inductor of claim 1, wherein said first portion of said first conductive path comprises a portion of an outer winding and an inner winding electrically coupled.

6. The differential inductor of claim 1, wherein said first portion of said second conductive path comprises a portion of an outer winding and a portion of an inner winding electrically coupled.

7. The differential inductor of claim 1, wherein said second portion of said first conductive path comprises a portion of an outer winding.

8. The differential inductor of claim 1, wherein said second portion of said second conductive path comprises a portion of an inner winding.

9. The differential inductor of claim 1, wherein said third portion of said second conductive path comprises a portion of an outer winding.

10. The differential inductor of claim 1, wherein said second portion of said first conductive path is configured to receive a signal through the second port and couple the signal to the third portion of said second conductive path on said second plane, said third portion of said second conductive path configured to couple the signal to the fourth conductive path on said third plane, said fourth conductive path configured to couple the signal to the second portion of said second conductive pathway on said second plane, said second portion of said second conductive path configured to couple the signal to the third conductive path on said third plane, said third conductive path configured to couple the signal to the first portion of said second conductive path on said second plane, and said first portion of said second conductive path configured to couple the signal to the first portion of the first conductive path on said first plane.

11. A method for forming a differential inductor comprising:

forming a first conductive path lying in a first plane having a first portion coupled to a first port and a second portion coupled to a second port, forming a second conductive path lying in a second plane spaced apart from the first plane having a first portion, a second portion and a third portion, and forming a third conductive path and a fourth conductive path each lying in a third plane spaced apart from the first plane and second plane, said first portion of said first conductive path configured to receive a signal through the first port and couple the signal to the first portion of said second conductive path on said second plane, said first portion of said second conductive path configured to couple the signal to the third conductive path on said third plane, said third conductive path configured to couple the signal to said second portion of said second conductive path on said second plane, said second portion of said second conductive path configured to couple the signal to said fourth conductive path on said third plane, said fourth conductive path configured to couple the signal to the third portion of said second conductive path on said second plane, and said third portion of said second conductive path configured to couple the signal to the second portion of said first conductive path.

12. A differential inductor system comprising:

a substrate including semiconductor technology, and an inductor including:

a first conductive path lying in a first plane having a first portion coupled to a first port and a second portion coupled to a second port, a second conductive path lying in a second plane spaced apart from the first plane, having a first portion, a second portion, and a third portion, and a third conductive path and a fourth conductive path each lying in a third plane spaced apart from the first plane and second plane, said first portion of said first conductive path configured to receive a signal through the first port and couple the signal to the first portion of said second conductive path on said second plane, said first portion of said second conductive path configured to couple the signal to the third conductive path on said third plane, said third conductive path configured to couple the signal to said second portion of said second conductive path on said second plane, said second portion of said second conductive path configured to couple the signal to said fourth conductive path on said third plane, said fourth conductive path configured to couple the signal to the third portion of said second conductive path on said second plane, and said third portion of said second conductive path configured to couple the signal to the second portion of said first conductive path.

* * * * *